US005645454A

United States Patent [19]

Kosmala

[11] Patent Number: 5,645,454

[45] Date of Patent: Jul. 8, 1997

[54] RIGHT ANGLE COAXIAL CONNECTOR AND METHOD OF ASSEMBLING SAME

[75] Inventor: Michael Lawrence Kosmala, Aliso Viejo, Calif.

[73] Assignee: ITT Corporation, New York, N.Y.

[21] Appl. No.: 562,486

[22] Filed: Nov. 24, 1995

[51] Int. Cl.[6] ..... H01R 17/04

[52] U.S. Cl. ..... 439/675; 439/607; 439/63

[58] Field of Search ..... 439/675, 581, 439/63, 95, 607, 609, 596, 947

[56] References Cited

U.S. PATENT DOCUMENTS

| | | | |
|---|---|---|---|
| 3,179,912 | 4/1965 | Huber et al. | 439/63 |
| 4,846,711 | 7/1989 | Kobler et al. | 439/63 |
| 4,946,392 | 8/1990 | Kobler et al. | 439/63 |
| 5,011,415 | 4/1991 | Suzuki et al. | 439/63 |
| 5,116,245 | 5/1992 | Baker | 439/581 |
| 5,167,531 | 12/1992 | Broschard, III et al. | 439/607 |
| 5,207,597 | 5/1993 | Kline et al. | 439/607 |
| 5,215,470 | 6/1993 | Henry et al. | 439/63 |
| 5,266,038 | 11/1993 | Nakamura | 439/79 |
| 5,334,050 | 8/1994 | Andrews | 439/579 |
| 5,362,255 | 11/1994 | Anhalt | 439/582 |

FOREIGN PATENT DOCUMENTS 5-152037 11/1991 Japan .

*Primary Examiner*—David Pirlot
*Assistant Examiner*—Tho Dac Ta
*Attorney, Agent, or Firm*—Thomas L. Peterson

[57] ABSTRACT

A right angle coaxial connector is disclosed which employs a die cast housing in which the center contact of the connector is mounted. The housing has a rearwardly-extending flap, and side walls that are perpendicular to the flap. The side walls have arcuate-shaped forming surfaces thereon over which the flap is bent downwardly to close the rear of the housing.

13 Claims, 5 Drawing Sheets

RIGHT ANGLE COAXIAL CONNECTOR AND METHOD OF ASSEMBLING SAME

BACKGROUND OF THE INVENTION

The present invention relates generally to a coaxial connector and, more particularly, to a right angle coaxial connector having a die cast housing.

Coaxial connectors fall into two general categories, namely, those employing stamped outer contacts, and those having zinc die cast outer contacts or housings. A stamped contact coaxial connector typically consists of three components, namely an insulator, a center contact, and a sheet metal stamped outer contact. The assembly procedure for such a connector is quite simple since all operations occur in the same axial direction and, hence, manual as well as fully automated assembly is possible, which is presently being conducted in the industry.

Stamped contact coaxial connectors have the advantage of low cost components at the expense of lesser electrical performance as compared to zinc die cast coaxial connectors, a relatively large up-front capital expenditure, and a lack of manufacturing flexibility.

Coaxial connectors having zinc die cast outer housings offer better electrical performance and manufacturing flexibility than stamped contact coaxial connectors. However, the zinc die cast connectors have more components and the assembly of the connectors is more complex, resulting in higher assembly costs than required for the assembly of stamped contact coaxial connectors.

An example of a zinc die cast right angle coaxial connector is disclosed in U.S. Pat. No. 5,215,470. The connector employs three die cast parts, two insulators, and a center contact. Such a connector is relatively expensive due to the large number of components, and the number of steps that are required to assemble the connector.

U.S. Pat. Nos. 4,846,711 and 5,011,415 disclose stamped contact right angle coaxial connectors in which the outer contact is provided with a rearwardly-extending flap that is bent downwardly after the center contact and insulator are mounted through the opening at the rear of the outer contact during the assembly process. The bending of the flap can be readily accomplished because the outer contact is formed of sheet metal that is malleable and, therefore, easily formed. The use of a die cast housing with a flap in a right angle coaxial connector has not been used due to the poor formability of the zinc die cast material. Uncontrolled bending of a die cast flap can result in the immediate cracking of the flap off of the housing. Even if the flap does not crack, surface cracking will normally occur at the bend which results in corrosion and possible fracturing of the flap at the bend in time.

It would be desirable to have, and it constitutes the object of the present invention to provide, a right-angle coaxial connector employing a die cast outer housing having a flap that can be suitably formed without causing damage to the housing, and that may be produced at a cost approaching that of a stamped contact-style connector, while maintaining the higher electrical performance characteristics afforded by the use of the die cast housing.

SUMMARY OF THE INVENTION

According to a principal aspect of the present invention, there is provided a right angle coaxial connector in which the center contact and insulator are mounted through the opening in the rear of a generally rectangular-shaped die cast housing. The upper wall of the housing embodies a rearwardly-extending flap. The side walls of the housing have arcuate-shaped forming surfaces thereon that face the flap. The flap is bent downwardly over the arcuate surfaces in a controlled manner to close the opening in the rear of the housing. Because of the controlled bending of the flap over the arcuate-shaped forming surfaces on the side walls of the housing, cracking of the housing at the bend region will not occur. Accordingly, by the present invention there is provided a right angle coaxial connector which has a minimum number of parts, is easy to assemble, and has electrical performance characteristics more favorable than stamped contact coaxial connectors.

DESCRIPTION OF THE PREFERRED EMBODIMENTS

Figure 1:
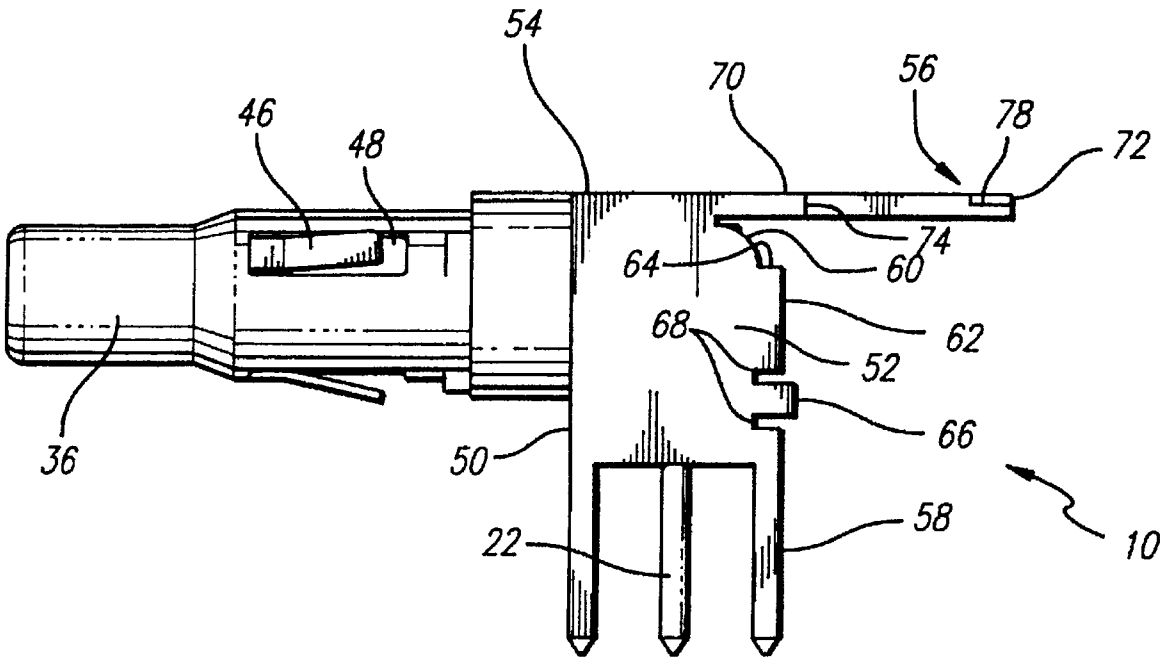
FIG. 1 is a side view of the right angle coaxial connector of the present invention, in the form of a plug connector, with the flap of the die cast housing shown in its initial open position.
Figure 2:
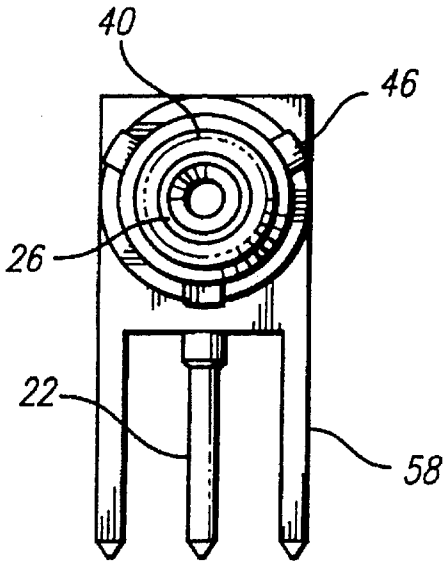
FIG. 2 is a front end view of the connector illustrated in FIG. 1.
Figure 3:
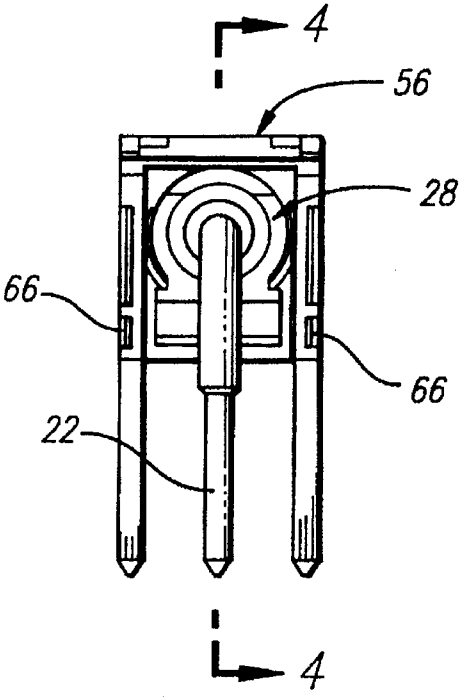
FIG. 3 is a rear end view of the connector illustrated in FIG. 1.
Figure 4:
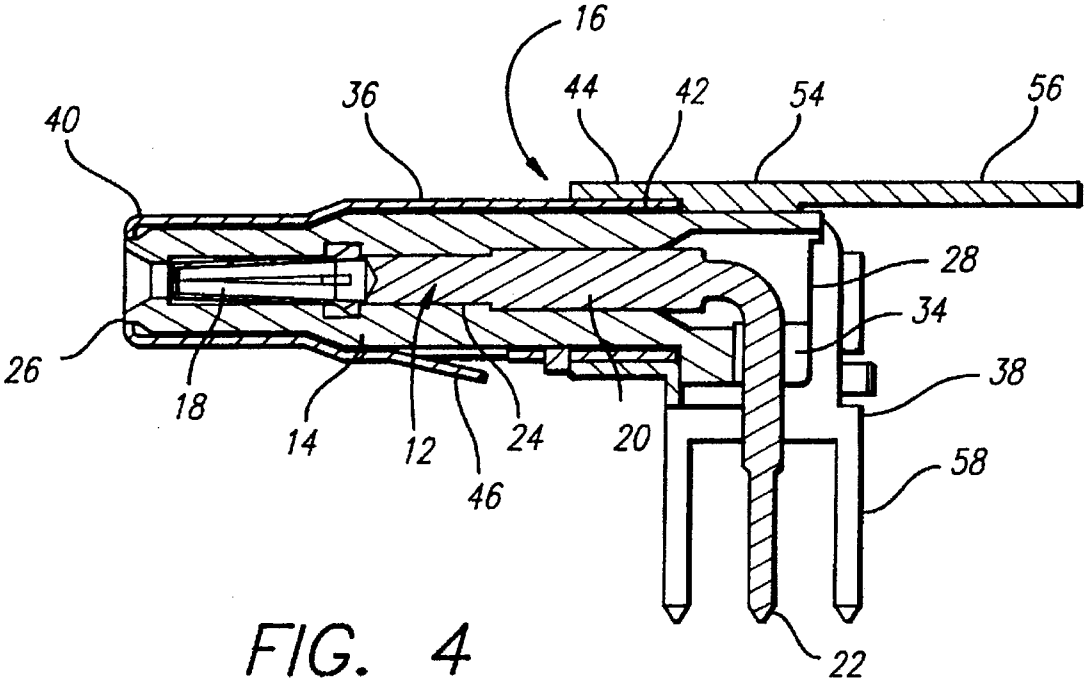
FIG. 4 is a vertical sectional view taken along line 4—4 of FIG. 3.
Figure 9:
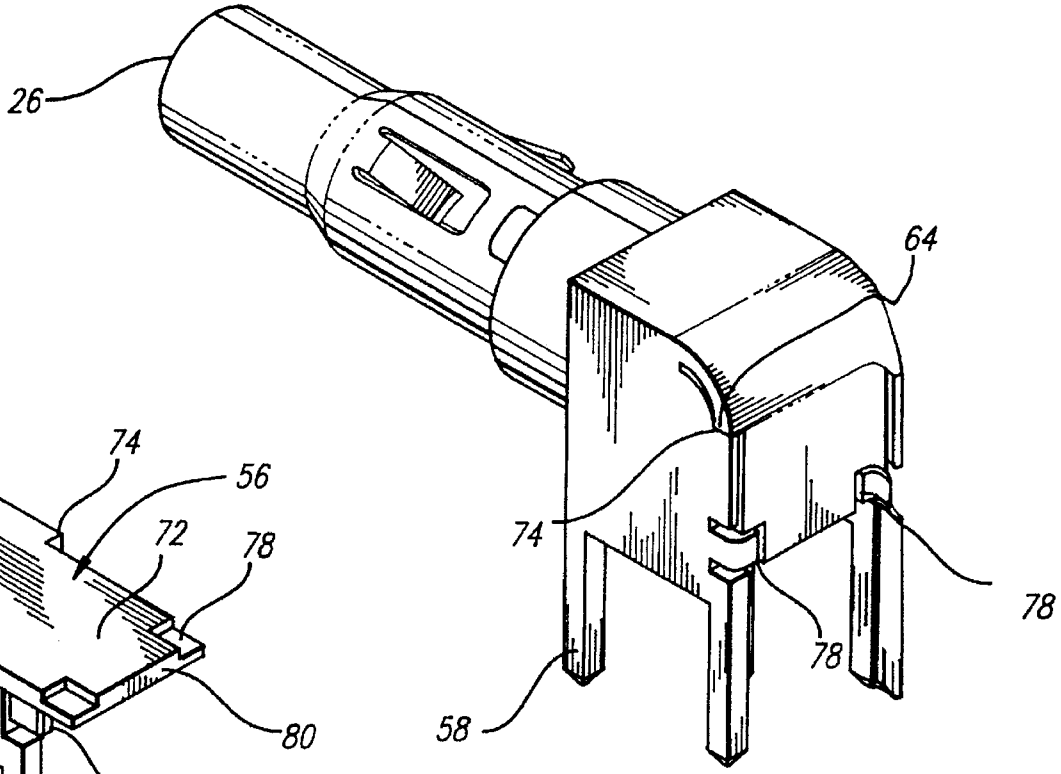
FIG. 9 is an isometric view of the completed connector illustrated in FIGS. 6–8, looking from the front of the connector.

Referring now to the drawings in detail, there is illustrated in FIGS. 1–5 a right angle plug coaxial connector, generally designated 10, in which the bendable flap of the connector is shown in its open position. The connector 10 includes a right angle center contact 12, an insulator 14, and a conductive enclosure 16 in which the center contact and the insulator are mounted.

The center contact 12 has a generally horizontally-extending forward mating portion 18, an intermediate mounting portion 20, and a rear leg 22 that extends downwardly in a vertical direction, or generally perpendicular to the mounting portion 20.

The insulator 14 has a central longitudinally-extending bore 24 that extends from the front 26 of the insulator to the rear 28 thereof. The mounting portion 20 of the contact is mounted in the bore 24, with the forward mating portion 18 adjacent to the front 26 of the insulator. In the embodiment shown in FIG. 4, the forward mating portion is in the form of a socket, that is adapted to receive the central pin contact 30 of the mating receptacle connector, generally designated 32, illustrated in FIG. 10.

A slot 34 extends forwardly from the rear 28 of the insulator 14 through which the vertical leg 22 extends.

The conductive enclosure 16 of the connector 10 preferably consists of two parts, namely, a stamped and formed sheet metal shell 36 and a zinc or zinc alloy die cast housing 38. The shell 36 has a cylindrical forward outer contacting portion 40 that surrounds the forward portion of the insulator 14, and a rear larger diameter, cylindrical portion 42 which has a close fit within a forward crimp sleeve portion 44 of the housing 38. The sleeve 44 is crimped around the rear portion 42 of the shell 36 to secure the shell within the housing.

Resilient contact retention fingers 46 are provided in the shell 36 by cutting U-shaped slots 48 in the blank that forms the shell, and bending the fingers outwardly so that they extend in a rearward direction. The retention fingers are adapted to engage a shoulder in the body of a connector (not shown) in which the coaxial connector 10 is mounted for releasably retaining the coaxial connector in such body. Alternatively, the connector body could incorporate a contact retention clip that engages a shoulder on the enclosure 16 of the coaxial connector 10 for retaining such connector in the connector body. In such case, the retention fingers 46 could be eliminated, and the shell 36 could be formed of die cast metal, and be integral with the housing 38 to provide a one-piece housing.

The rear part 49 of the housing 38 has a generally rectangular configuration, and includes a front wall 50, generally parallel side walls 52 that extend rearwardly from the front wall, and an upper wall 54. The bottom and rear of the housing 38 are open. The upper wall of the housing includes a rearwardly-extending flap 56.

Two grounding posts 58 extend downwardly from the front and rear portions of each of the side walls 52 of the housing 38. The leg 22 of the center contact is disposed centrally with respect to the four grounding posts 58.

According to the present invention, each of the side walls 52 of the rectangular rear part 49 of the die cast housing 38 is formed with an arcuate-shaped forming surface 60 adjacent to the rear edge 62 of the side wall, and facing in the direction of the flap 56. The arcuate surface preferably has the shape of a quarter circle. The lower edge of the surface terminates at an upwardly facing shoulder 64 that extends to the rear edge 62 of the side wall.

Spaced below the shoulder 64, and above the bottom of each side wall 62, there is provided a tab 66 formed by two slots 68 opening at the rear edge 62 of the side wall. The tab 66 extends a short distance behind such rear edge.

The flap 56 of the die cast housing 38 has a forward section 70 that merges with the upper wall 54 of the housing, and a rear section 72 that has a width less than the width of the forward section, providing rearwardly-facing shoulders 74 along the side edges of the flap where the forward and rear sections thereof meet. The width of the forward section 70 of the flap is equal to the distance between the outer surfaces of the parallel side walls 52, while the width of the flap rear section 72 is slightly less than the distance between the inner surfaces of the side walls.

Figure 5:
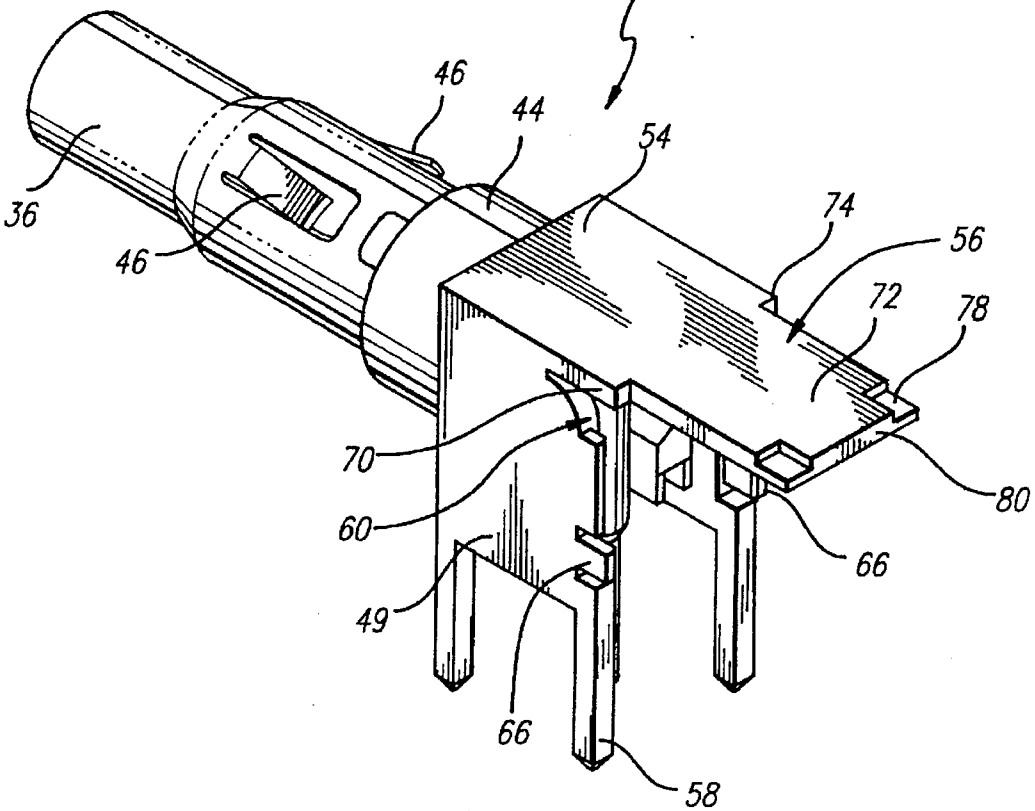
FIG. 5 is an isometric view of the connector illustrated in FIGS. 1–4, looking from the rear of the connector.
Figure 7:
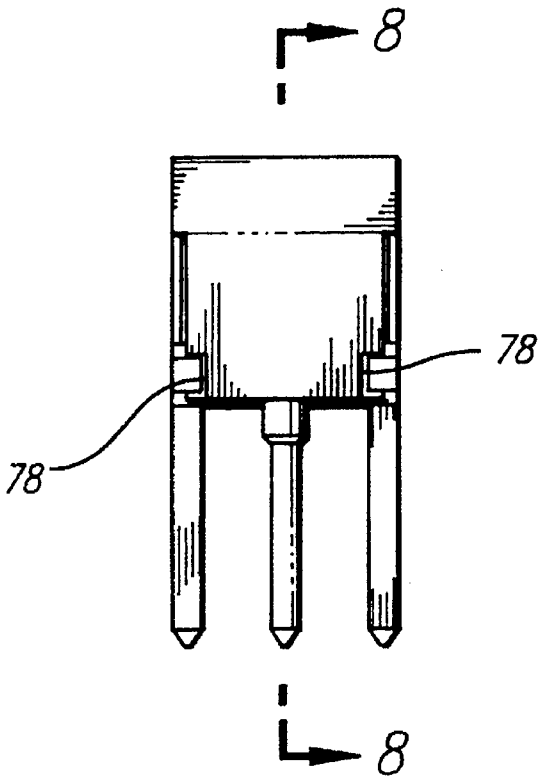
FIG. 7 is a rear end view of the connector illustrated in FIG. 6.
Figure 6:
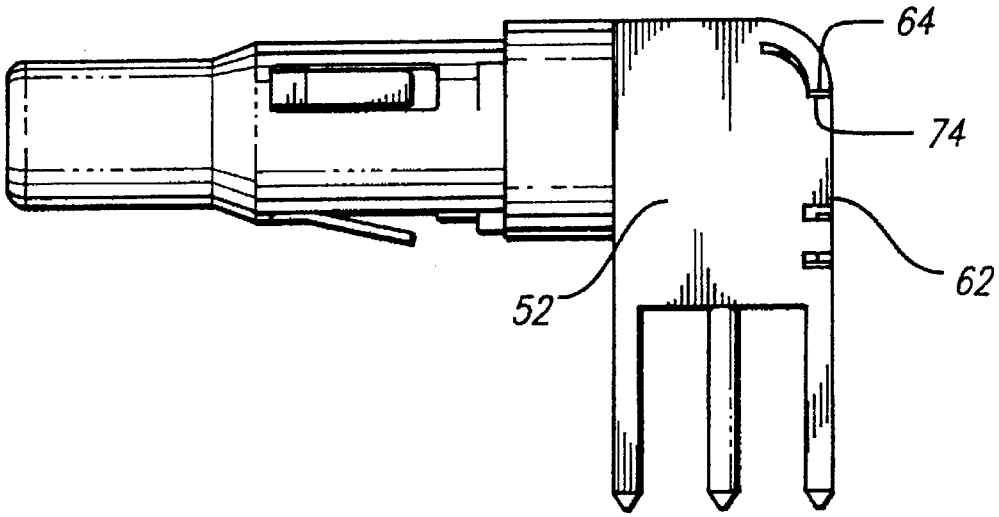
FIG. 6 is a side view of the connector illustrated in FIGS. 1–5, with the flap of the die cast housing bent to its final position.
Figure 8:
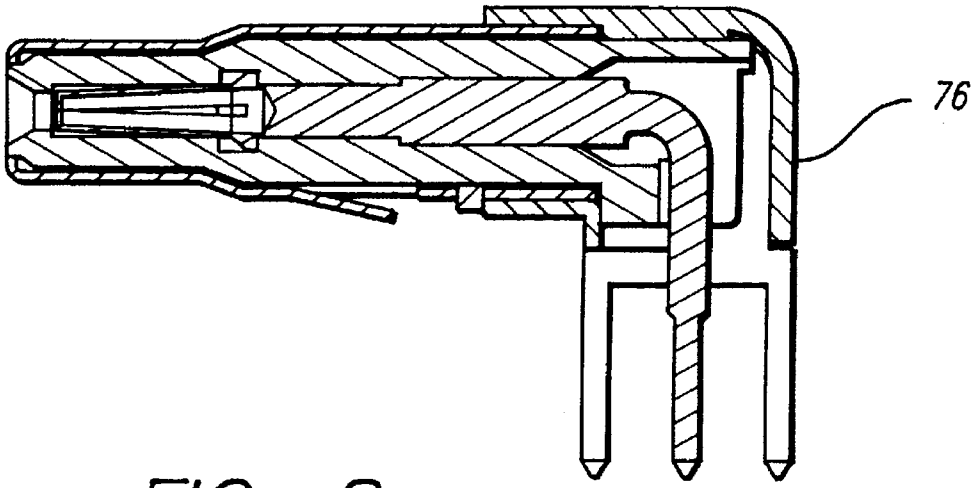
FIG. 8 is a vertical sectional view taken along line 8—8 of FIG. 7.

To assemble the connector 10 of the present invention, initially the right angle center contact 12 is mounted within the bore 24 in the insulator 14. The subassembly thus formed is then mounted in the enclosure 16 through the open rear end of the die cast housing 38. Thereafter, the flap 56 is bent downwardly from the horizontal position shown in FIGS. 1, 4, and 5 to a vertical position as best seen in FIGS. 6 and 8. The bending of the flap 56 occurs at the forward section 70 of the flap in a controlled manner since the forming surfaces 60 on the side walls 52 on the die cast housing function as anvils permitting a gradual and smooth bending of the flap until the rear section reaches its final vertical position. In such position, shoulders 74 on the side regions of the flap abut the shoulders 64 on the side walls of the housing, and the rear section 72 of the flap is disposed between the side walls adjacent to the rear of the housing, with the outer surface 76 of the flap lying flush with the rear edges 62 of the housing side walls. Thereafter, the tabs 66 of the side walls are bent inwardly into corresponding recesses 78 formed in the outer surface of the rear section of the flap adjacent to the end 80 of the flap. Such recesses are best seen in FIGS. 5 and 7.

By the foregoing arrangement, the die cast housing 38 is virtually completely closed, to provide complete shielding for the center contact 12. The housing also provides a grounding connection between the metal shell 36 through the posts 58 to ground traces on a printed circuit board, not shown, on which the connector 10 is mounted, with the posts suitably mounted in plated-through holes in the board in a manner well known in the art.

The particular configuration of the flap 56 and the side walls of the die cast housing 38 disclosed herein also provides a final product having a pleasing appearance.

Figure 10:
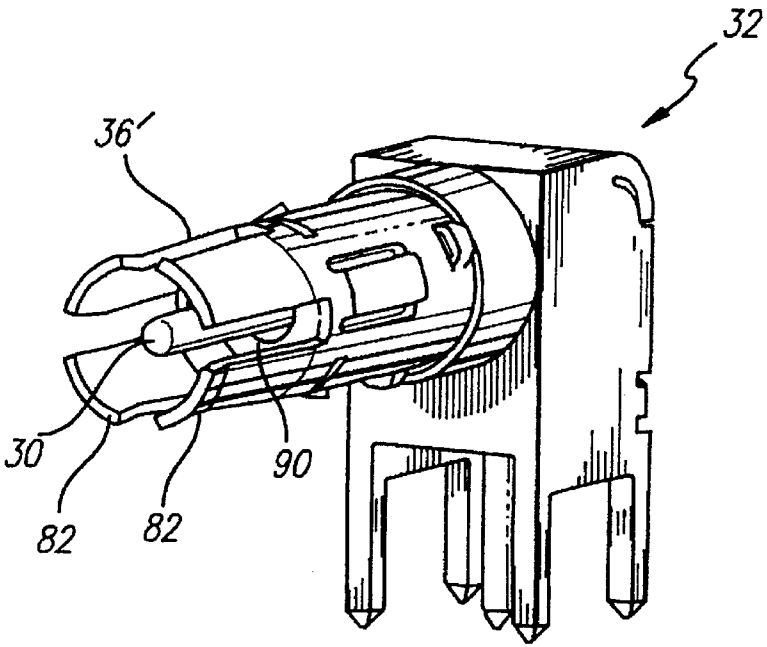
FIG. 10 is an isometric view of a receptacle connector constructed according to the present invention, which is mateable with the plug connector illustrated in FIGS. 1–9.

Reference is now made to FIG. 10 of the drawings which shows the receptacle right angle connector 32 that is adapted to mate with the plug connector 10 of the invention. The connector 32 is identical to the connector 10, except that the center contact 30 is a pin contact, and slots 90 are formed in the forward portion of the shell 36' to provide resilient spring fingers 82. The fingers engage the forward outer contacting portion 40 of the shell 36 of the plug connector 10 when the plug connector is mated with the receptacle connector 32.

From the foregoing, it will be appreciated that by the present invention there is provided a right angle coaxial connector that employs a die cast housing, which affords desirable electrical performance, and requires only a minimum number of components. The bending of the flap on the housing is performed in a controlled manner by the provision of the arcuate-shaped forming surfaces 60 on the side walls of the housing, which assures that a bending of the flap will not result in fractures occurring that could cause failure of the connector either immediately during the bending operation, or later due to corrosion occurring in surface cracks that might otherwise arise if the bending of the flap were performed in an uncontrolled manner.

Although particular embodiments of the invention have been described and illustrated herein, it is recognized that modifications and variations to the invention may readily occur to those skilled in the art and, consequently, it is intended that the claims be interpreted to cover such modifications and equivalents.

What is claimed is:

1. A right angle coaxial connector comprising:

an insulator having a horizontally-extending bore therethrough;

a right angle center contact mounted in said bore, said contact having a forward mating portion and a rear vertically-extending leg at a rear portion of said insulator;

a conductive enclosure substantially enclosing said center contact and said insulator;

said enclosure having a forward outer contacting portion and a rear die cast housing, said housing having a generally rectangular configuration and includes a front wall, an upper wall, opposite side walls having rear edges and at least one downwardly-extending grounding post;

said upper wall embodying a rearwardly-extending flap bent downwardly to a position adjacent to said rear edges of said side walls behind said center contact leg; and said side walls having arcuate-shaped forming surfaces thereon facing said flap, over which said flap is bent.

2. A coaxial connector as set forth in claim 1 wherein:

said housing is formed of one piece of metal.

3. A coaxial connector as set forth in claim 1 wherein:

said forward outer contacting portion of said enclosure is a sheet metal shell secured to said housing.

4. A coaxial connector as set forth in claim 3 wherein:

said shell has a rear cylindrical portion; and said housing has a sleeve extending forwardly from said front wall, said sleeve and said rear cylindrical portion of said shell being mounted in telescoping relationship and crimped to each other.

5. A coaxial connector as set forth in claim 3 wherein:

said sheet metal shell embodies at least one outwardly extending, resilient contact retention finger.

6. A coaxial connector as set forth in claim 1 wherein:

said side walls embody rearwardly-extending tabs bent behind said flap to retain said flap in said downwardly bent position.

7. A coaxial connector as set forth in claim 6 wherein:

said flap has a forward section and rear section of a width less than the width of said forward section providing shoulders along the edges of said flap where said sections merge with each other;

the width of said flap rear section is slightly less than the distance between said side walls;

each said side wall has an upwardly-facing shoulder extending from the bottom of its respective arcuate surface to the rear edge of said side wall; and said shoulders on said flap engage said side wall shoulders, and said rear section of said flap is disposed between said side walls.

8. A coaxial connector as set forth in claim 7 wherein:

said rear section of said flap has an outer surface generally coplanar with said rear edges of said side walls.

9. A coaxial connector as set forth in claim 8 wherein:

recesses are provided in said outer surface of said rear section of said flap into which said tabs extend.

10. In a right angle coaxial connector, including a right angle center contact having a forward mating portion, an intermediate mounting portion, and a rear leg generally perpendicular to said mounting portion, an insulator surrounding at least said mounting portion of said contact, and a die cast housing surrounding said insulator in the region of said leg, said housing having walls forming a rear opening, the improvement comprising:

one of said walls having a rearwardly-extending flap;

another of said walls extending generally perpendicular to said flap and having an arcuate-shaped forming surface thereon facing said flap; and said one wall being bent over said forming surface to substantially close said rear opening.

11. A coaxial connector as set forth in claim 10 wherein:

said housing has a third wall generally parallel to said other wall;

said third wall has an arcuate-shaped forming surface thereon facing said flap;

said forming surfaces are aligned with the opposite side regions of said flap; and said flap is bent over both said forming surfaces.

12. A method of assembling a right angle coaxial connector having an insulator with a bore extending therethrough, a right angle contact having a forward mating portion and a rear leg generally perpendicular to said mating portion, and a die cast housing having side walls and an upper wall forming a rear opening, said upper wall having a rearwardly-extending flap, at least one of said side walls having an arcuate-shaped forming surface thereon facing said flap, the method comprising the steps of:

inserting the forward mating portion of said contact into the bore in said insulator to form a subassembly;

inserting said subassembly into said housing through said rear opening; and bending said flap downwardly over said arcuate surface to substantially close said rear opening.

13. The method as recited in claim 12 wherein:

tabs on said side walls of said housing are bent behind said flap after said flap is bent to close said rear opening.

* * * * *